US010403950B2

(12) United States Patent
Kirkeby

(10) Patent No.: US 10,403,950 B2
(45) Date of Patent: Sep. 3, 2019

(54) CIRCULATOR WITH MODIFIED BIAS TO PREVENT HIGHER ORDER MODES

(71) Applicant: ANAREN, INC., East Syracuse, NY (US)

(72) Inventor: Niels Kirkeby, Jamesville, NY (US)

(73) Assignee: ANAREN, INC., East Syracuse, NY (US)

( * ) Notice: Subject to any disclaimer, the term of this patent is extended or adjusted under 35 U.S.C. 154(b) by 25 days.

(21) Appl. No.: 15/415,219

(22) Filed: Jan. 25, 2017

(65) Prior Publication Data

US 2017/0214108 A1 Jul. 27, 2017

Related U.S. Application Data

(60) Provisional application No. 62/286,919, filed on Jan. 25, 2016.

(51) Int. Cl.
*H01P 1/387* (2006.01)

(52) U.S. Cl.
CPC ..... *H01P 1/387* (2013.01)

(58) Field of Classification Search
CPC .. H01P 1/387; H01P 1/383; H01P 1/36; H01P 1/38
USPC ..... 333/1.1, 24.2
See application file for complete search history.

(56) References Cited

U.S. PATENT DOCUMENTS

2010/0259336 A1* 10/2010 Bunce ..... H01P 1/387 333/1.1

* cited by examiner

*Primary Examiner* — Stephen E. Jones
(74) *Attorney, Agent, or Firm* — Polsinelli PC

(57) ABSTRACT

An approach to modifying bias in a circulator to prevent higher order modes that involves the use of features positioned near the ferrite material of the circulator. The ferrite bias in the perimeter of the ferrite material is modified by the adjacent features such that higher order modes cannot be sustained. The features may include scallops that create a non-uniform magnetic field towards the perimeter of the ferrite while leaving the field near-uniform in the center where the fundamental circulator mode primarily resides. Alternatively, slots may be placed in the magnetically conductive housing bottom in the region of the edge of the ferrite material to prevent higher order modes.

10 Claims, 5 Drawing Sheets

CIRCULATOR WITH MODIFIED BIAS TO PREVENT HIGHER ORDER MODES

CROSS-REFERENCE TO RELATED APPLICATIONS

The present application claims priority to U.S. Provisional Application No. 62/286,919, filed on Jan. 25, 2016.

BACKGROUND OF THE INVENTION

1. Field of the Invention

The present invention relates to circulators and, more specifically, to features in the housing which alters the magnetic bias in the ferrite media of the circulator and prevent the formation of higher order modes.

2. Description of the Related Art

RF/microwave circulators often exhibit higher order modes similar to what can occur in waveguides. Stripline circulators are often in circular housings exhibiting similar modes as a circular waveguide. Prior art solutions to prevent these modes include changing the dimensions of both the housing and the ferrite pucks within the housings. However, for size constrained designs this is not an option and, in particular, for wide bandwidth (>10%) it can be difficult to find dimensions that avoid all possible modes that can be excited in the frequency band of interest. Another prior art solution to prevent/eliminate mode is to use an absorptive material placed such as to absorb the field associated with mode(s) while having minimal impact on the fundamental. However, using absorber materials adds cost both for the material itself and for the added assembly steps required to install it. Additionally, using absorber materials does not always stop the undesired mode from forming, but rather dissipates it which add loss to the fundamental frequency. Accordingly, there is a need in the art for a solution that prevents the formation of the undesired higher order modes in resonance stripline circulators and isolators.

BRIEF SUMMARY OF THE INVENTION

The present invention modifies bias in a circulator to prevent higher order modes by using scalloped features in the magnetically conductive housing of the circulator. The ferrite bias in the perimeter of the ferrite material is modified such that higher order modes cannot be sustained because the scallops create a non-uniform magnetic field towards the perimeter of the ferrite while leaving the field near-uniform in the center where the fundamental circulator mode primarily resides. Alternatively, slots may be placed in the magnetically conductive housing bottom in the region of the edge of the ferrite to prevent higher order modes.

In one embodiment of a stripline circulator according to the present invention, a ferrite element having a perimeter susceptible to the formation of higher order modes is positioned within a magnetically conductive housing that surrounds the perimeter of the ferrite element. The magnetically conductive housing has an internal surface with a series of features formed therein that create a non-uniform magnetic field near the perimeter of the ferrite element. The series of features do not alter any uniform magnetic field in a center of the ferrite element. The features are positioned within two thousands of an inch from the perimeter of the ferrite element. The series of features preferably comprise scallops and the ferrite elements is centered within said scallops. The scallops may be varied in size.

In another embodiment, the present invention is a a stripline circulator comprising a ferrite element having a perimeter susceptible to the formation of higher order modes and a magnetically conductive housing surrounding said perimeter of said ferrite element and including a housing bottom positioned under said ferrite element. A slot is positioned in the housing bottom that spans a portion of said perimeter of said ferrite element.

The present invention also includes a method of the reducing the formation of higher order modes in a stripline circulator. The method involves the steps of providing a magnetically conductive housing around a ferrite element susceptible to the formation of higher order modes and including a feature in the magnetically conductive housing to reduce the formation of higher order modes. When the magnetically conductive housing surrounds a perimeter of the ferrite element, the feature comprises a series of scallops formed in an internal surface of the magnetically conductive housing that create a non-uniform magnetic field near said perimeter of said ferrite element. Alternatively, the magnetically conductive housing may include a housing bottom positioned under the ferrite element and the feature may comprise a slot positioned in the housing bottom that spans a portion of the perimeter of the ferrite element.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1A:
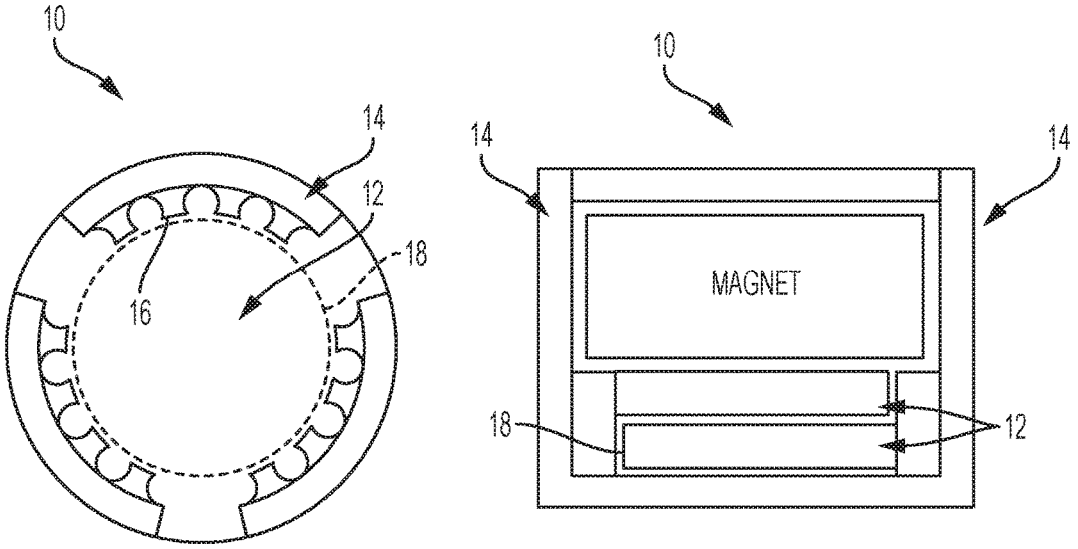
FIGS. 1A and 1B are schematics of a circulator having a series of scallops that modify ferrite bias according to a first embodiment of the present invention.
Figure 1B:
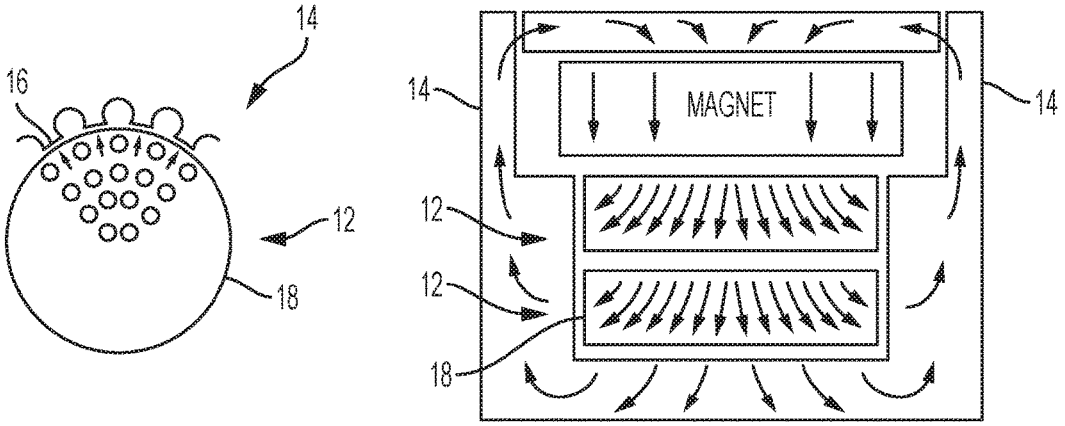

Referring now to the drawings, wherein like reference numerals refer to like parts throughout, there is seen in FIGS. 1A and 1B an above resonance circulator 10 having magnetically biased ferrite with typical number in the 1700-1900 MHz range. Generally, circulator 10 has a series of ferrite elements 12 surrounded by a magnetically conductive housing 14. According to the present invention, the internal surface of housing 14 includes a series of scallops 16 formed therein that are adjacent to and surround the perimeter 18 of the ferrite material. More particularly, as seen in FIG. 1A, the present invention changes the ferrite bias in the perimeter of the ferrite material, such that higher order modes cannot be sustained. As seen in FIG. 1B, scallops 16 shown in FIG. 1A create a non-uniform magnetic field towards the perimeter of the ferrite, while leaving the field near-uniform in the center where the fundamental circulator mode primarily resides.

Figure 2:
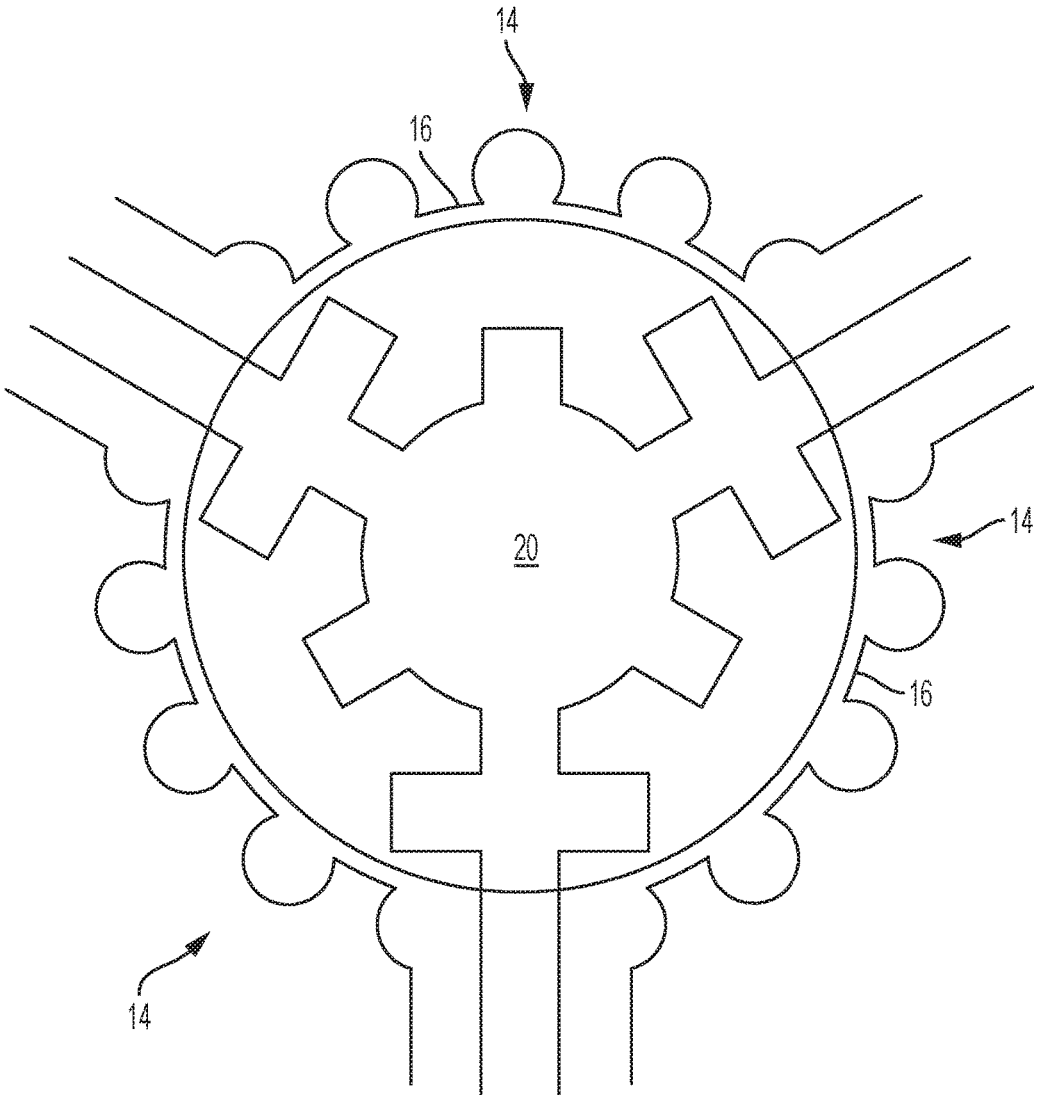
FIG. 2 is a schematic of a stripline circuit for a circulator having scalloped ferrite according to the present invention.
Figure 3:
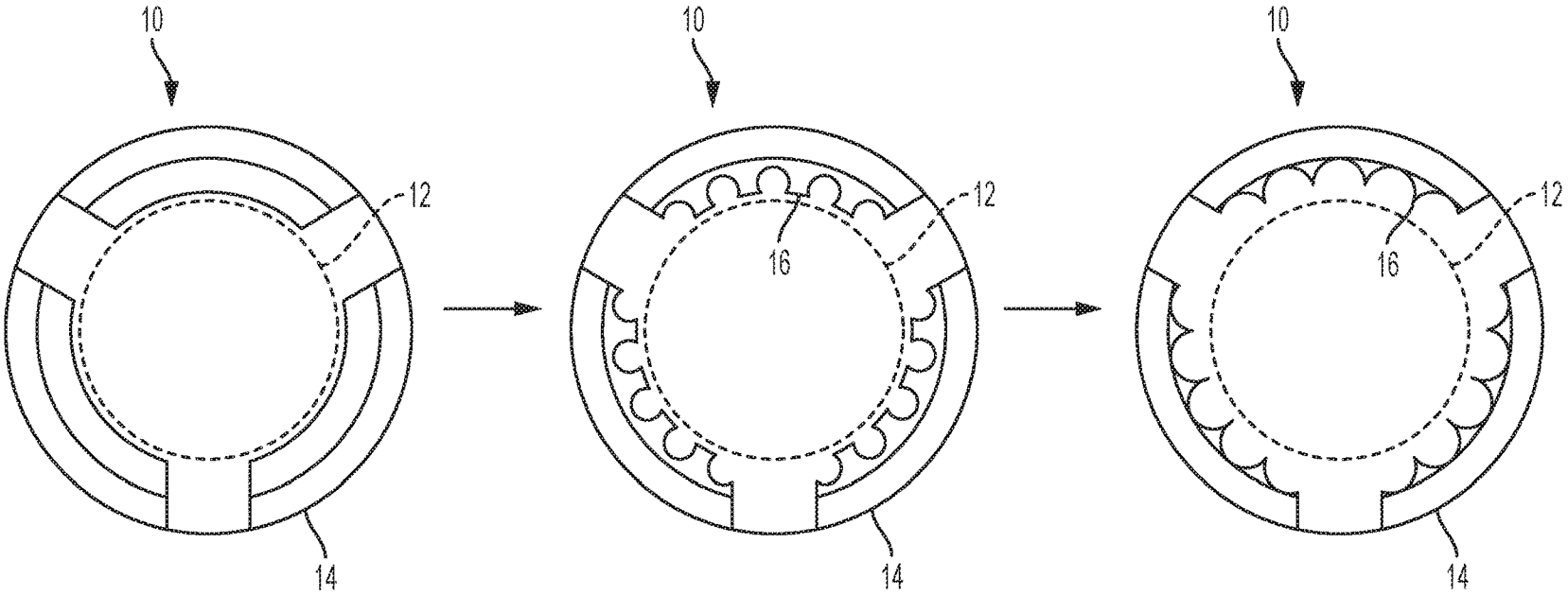
FIG. 3 is a schematic of variations in the scalloped ferrite of a circulator according to the present invention.
Figure 4:
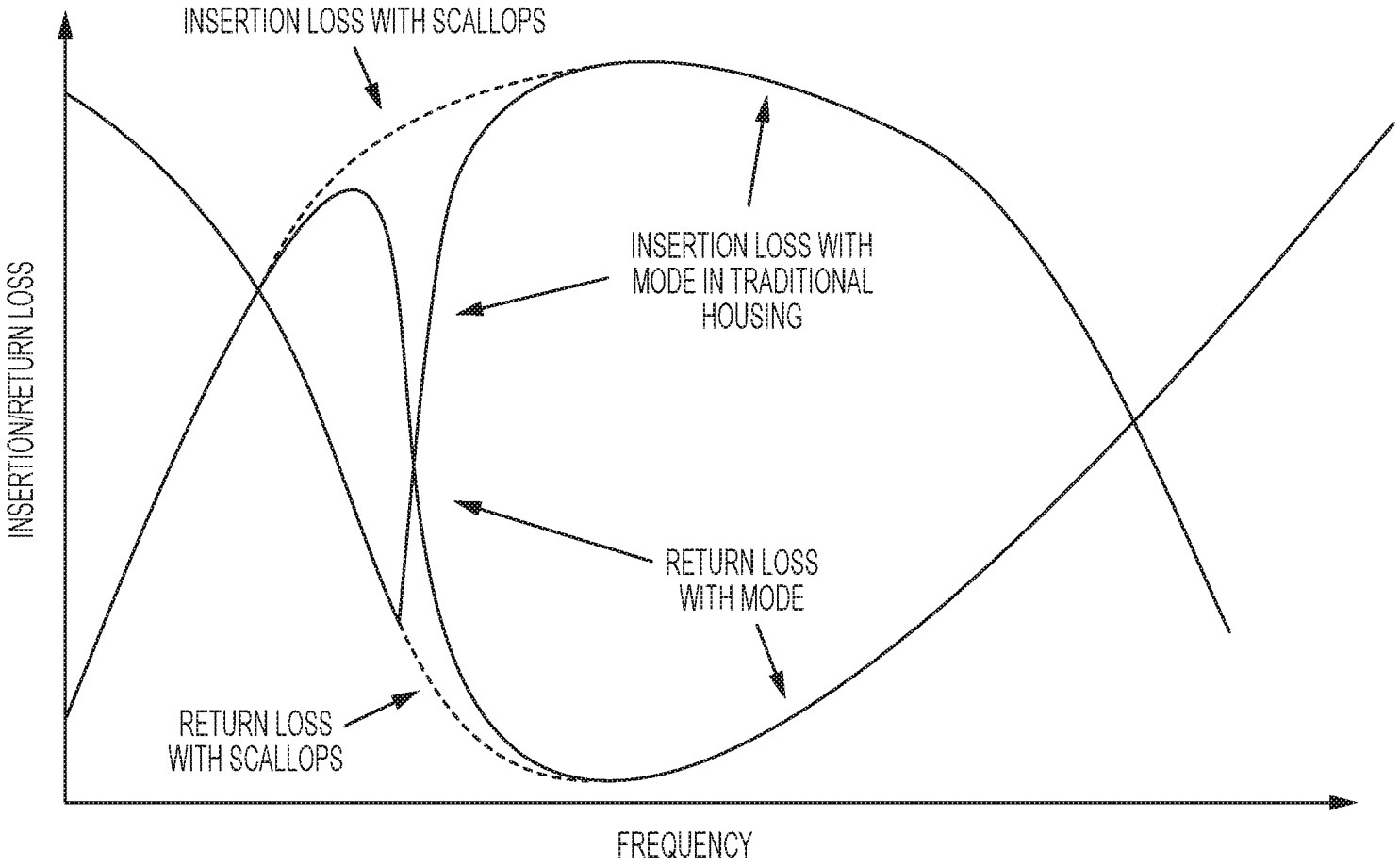
FIG. 4 is a graph of the effect of scalloped ferrite in a circulator according to the present invention verses a conventional circulator.

A stripline circuit 20 for circulator 10 that is modified to include scallops 16 according to the present invention is seen in FIG. 2. Because the active area for circulator 10 is primarily around stripline circuit 20, scallops 16 are affecting primarily ferrite areas that are inactive for the primary circulator operation. Since airgaps are effectively resistors to magnetic field liner, scallops 16 must get very close to ferrite 12 to be effective, i.e., within about 2 mils (0.002"). This arrangement also provides the added benefit of centering ferrite 12 in housing 14 to moderate the effect on the bias such as to prevent the higher order mode, while not significantly affecting the primary circulator operation. Thus, rather than changing the distance between shelves 22 and scallops 16, scallops 16 may be varied from a solid shelf to large scallops to small scallops, such as those seen in corresponding series in FIG. 3, to allow for adjustment of both a more uniform edge bias modification in the plane perpendicular to ferrite 12 and make the effects of misalignment less pronounced. The effect of a scalloped housing 14 on a higher order mode versus a traditional non-scalloped housing may be seen in FIG. 4.

Figure 5:
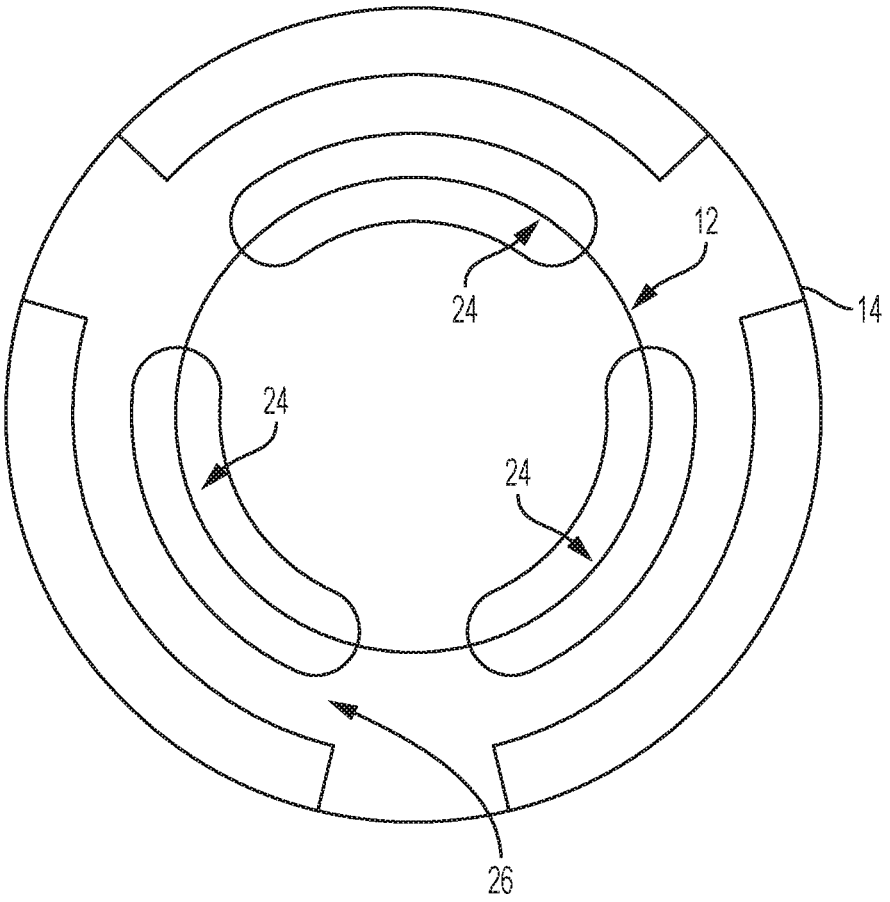
FIG. 5 is a graph of the use of slots to modify ferrite bias in a circulator according to another embodiment of the present invention.

Along with scalloped housing 14 of the present invention, other bias modifying features may be effective on some stripline designs and housing implementations. One such modifying feature is the use of slots 24 in the bottom 26 of magnetically conductive housing 14 in the region of perimeter 18 of ferrite 12, as seen in FIG. 5. In this embodiment of the present invention that involves slotted bottom 26 as the bias modifier, it may be necessary in a stripline circulator implementation to add an electric ground circuit or plating to ferrite 12 to avoid affecting the primary circulation mode. Slotted bottom 26 can also be implemented on the magnet side of ferrite 12, or the bottom 26 of housing 14, or on both.

It should be noted that if either scallops 16 or slots 24 are brought close to the stripline port position on the ferrite, a circuit re-design may become necessary in order to compensate for property change of ferrite 12 as function of the modified bias. The amount of scallops 16 or slots 24 will depends on the Q factors of the housing, linewidth, bias strength of ferrite 12, the amount of bias modification the relevant circuit can tolerate (which depends largely on the proximity of the circuit to perimeter 18 of ferrite 12, i.e., the "active" region of ferrite 12, and the specification for circulator 10, including intermodulation specification.

What is claimed is:

1. A stripline circulator, comprising:

a ferrite element having a perimeter susceptible to the formation of higher order modes; and a magnetically conductive housing surrounding said perimeter of said ferrite element and having an internal surface with a series of features formed therein that create a non-uniform magnetic field near said perimeter of said ferrite element.

2. The stripline circulator of claim 1, wherein said series of features do not alter any uniform magnetic field in a center of said ferrite element.

3. The stripline circulator of claim 2, wherein said features are positioned within two thousands of an inch from said perimeter of said ferrite element.

4. The stripline circulator of claim 3, wherein said series of features comprise scallops.

5. The stripline circulator of claim 4, wherein said ferrite element is centered within said scallops.

6. The stripline circulator of claim 5, wherein said scallops are varied in size.

7. A method of the reducing the formation of higher order modes in a stripline circulator, comprising the steps of:

providing a magnetically conductive housing surrounding a perimeter of a ferrite element susceptible to the formation of higher order modes;

wherein said magnetically conductive housing includes a series of features formed in an internal surface of said magnetically conductive housing that create a non-uniform magnetic field near said perimeter of said ferrite element to reduce the formation of higher order modes.

8. The method of claim 7, wherein the series of features comprise a series of scallops.

9. The method of claim 8, wherein said series of scallops are positioned within two thousands of an inch from said perimeter of said ferrite element.

10. The method of claim 9, wherein said ferrite element is centered within said scallops of said magnetically conductive housing.

* * * * *